United States Patent [19]

Matherly et al.

[11] Patent Number: 4,646,970

[45] Date of Patent: Mar. 3, 1987

[54] HAND-HELD WASHING DEVICE

[75] Inventors: Joseph E. Matherly, Champaign; Robert J. Fileccia, St. Joseph; Leslie J. Benson, Champaign, all of Ill.

[73] Assignee: The United States of America as represented by the Secretary of the Army, Washington, D.C.

[21] Appl. No.: 611,789

[22] Filed: May 18, 1984

[51] Int. Cl.[4] ..... B05B 9/01

[52] U.S. Cl. ..... 239/111; 239/288; 239/527; 137/107; 137/882

[58] Field of Search ..... 239/109, 111, 124, 126, 239/526, 527, 528, 288, 288.3; 285/45; 137/107, 517, 878, 881, 882

[56] References Cited

U.S. PATENT DOCUMENTS

| | | | |
|---|---|---|---|
| 1,303,472 | 5/1919 | Haas | 137/882 |
| 2,032,753 | 3/1936 | James | 285/45 |
| 3,589,621 | 6/1971 | Bradley | 239/526 |
| 3,701,478 | 10/1972 | Tada | 239/333 |
| 3,799,447 | 3/1974 | Beal | 239/288.5 |
| 3,869,089 | 3/1975 | Karasa et al. | 239/526 X |
| 3,885,739 | 5/1975 | Tuttle | 239/124 |
| 3,888,421 | 6/1975 | Chow | 239/456 |
| 4,216,907 | 8/1980 | Fuller | 239/526 X |
| 4,294,411 | 10/1981 | Hastings et al. | 239/528 X |
| 4,325,513 | 4/1982 | Smith et al. | 239/528 |

FOREIGN PATENT DOCUMENTS

| | | | |
|---|---|---|---|
| 2129334 | 5/1984 | United Kingdom | 239/526 |

*Primary Examiner*—Joseph F. Peters, Jr.
*Assistant Examiner*—Mary Beth O. Jones
*Attorney, Agent, or Firm*—Darrell E. Hollis

[57] ABSTRACT

Washing device of the gun type intended to be held by two hands. Designed when in operation to have a generally linear flow path for liquid to deliver the maximum volume of liquid at a given water pressure. Especially useful for washing mud from the tracks of military vehicles.

2 Claims, 4 Drawing Figures

HAND-HELD WASHING DEVICE

STATEMENT OF GOVERNMENT INTEREST

The invention described and claimed herein may be manufactured and used by or for the Government of the United States of America for governmental purposes without the payment of royalties thereon or therefor.

BACKGROUND OF THE INVENTION

This invention relates to a fluid control device of the gun type. More particularly, the invention relates to a washing device for connection to a hose, that is designed to be held by an operator using both hands, for directing a stream of water.

Often the washing of dirt from vehicles is done with the use of a hose nozzle that is designed for watering the lawn. At best such a nozzle produces a high velocity stream, and unfortunately such nozzles are often designed so that an adjustment that increases the velocity of the stream also restricts the throat area of the nozzle and decreases the volume of water delivered per unit of time. This actually reduces the effectiveness of the stream of water for removing large, heavy accumulations of mud from off-the-road vehicles, particularly tracked vehicles such as military personnel carriers and tanks.

Moreover, presently available hand-held washing nozzles are ordinarily made of brass, which has not proved to be the most durable material for heavy duty use. With such devices, there are two continuing problems. When such devices are not cared for properly in cold weather, they may freeze and burst. This not only represents an expense for replacing the device itself, but in addition may result in the loss of a substantial amount of water. Also, while such devices may be intended for vehicle washing applications, such as in a motor pool at a military installation, they are also useful about the home. There is therefore a pilferage problem.

SUMMARY OF THE INVENTION

This invention is a washing device intended to be held by both hands of the operator. It was developed for heavy duty, substantially continuous use. It is especially useful for washing mud from military vehicles such as half-tracks and tanks.

This device is of the gun type. It has an elongate body with socket means comprising a male connector at one end, intended to be coupled to the female coupling on a hose end. At its opposite end, the device has a barrel portion with a bore that is tapered from its inlet to a smaller diameter outlet, as hose nozzles often are.

The body of the device, intermediate the male connector at one end and the barrel at the other end, consists of several interconnected parts that have aligned bores that permit the flow of water through the device in an essentially linear flow path. Thus a tee having three arms is connected through one arm to the male part of the coupling. A freeze-and-bleed valve is mounted in a second arm of this tee. This valve opens automatically when there is no water pressure, to communicate with the environment, and is intended for draining water from the device and the hose to eliminate the danger of freezing. In operation of the device, water pressure keeps this valve closed.

The third arm of the tee is connected to a self-closing actuating valve that is interposed between the tee and the barrel. An actuating member or trigger is pivotally mounted on the body of the device, in position to be actuated to move the normally-closed actuating valve to an open position. This valve communicates with the barrel, so that water can flow through the device from one end to the other.

For protection, the device is provided with an elongate housing that is formed to fit snugly about the body of the device. The housing is formed with an opening so that the body can be inserted into the housing, with the body supported on the housing at both of its ends. Preferably some means is provided intermediate the ends of the housing for more securely fastening the body in place in the housing, so that there is no "play" between the body and housing.

The housing is also formed with a handgrip that is disposed to protect the trigger. The housing is also preferably formed with a second handgrip that is disposed at the front end of the device, adjacent the water outlet. The second handgrip facilitates handling and aiming of the device.

To discourage or prevent pilferage, a closure cover is preferably secured about the hose end, where the hose end is connected to the socket of the device for supplying water or other fluid to the device. The closure cover is secured to the body by one-way screws, so that once in place, the closure cap can be removed by backing out the screws only by the use of a special tool.

This device is particularly useful for clearing off heavy accumulations of mud from tracked vehicles. It has the advantage, because of its design, of being able to supply a large volume of water per unit time, at a suitable pressure. The pressure is helpful in dislodging the mud, but the large volume of water is essential for carrying the mud away. This is important since a half-track vehicle may pick up a ton of mud, or even more, on its tracks. Also, it is designed to be durable and light in weight. It may be made pilferage-resistant by using the closure cover.

DETAILED DESCRIPTION OF THE DRAWINGS

Figure 2:
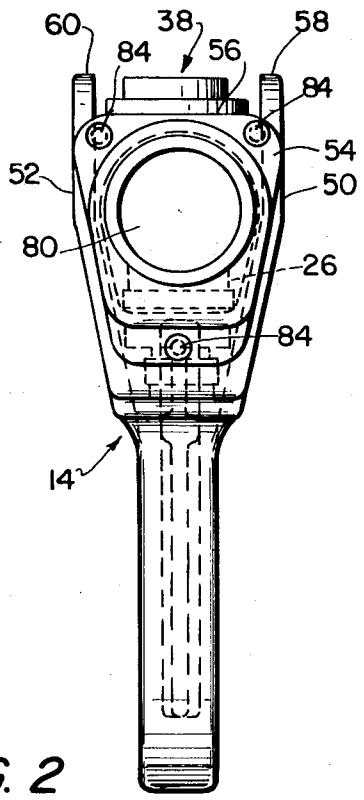
FIG. 2 is an end view thereof.

Referring now in detail to the drawings by numerals of reference, the numeral 10 denotes generally a washing device that is constructed in accordance with one embodiment of the invention. This device consists of a body 12 that is encased in and protected by a housing 14.

Beginning at the inlet end of the device, its body comprises a male coupling fitting 16 to which a female coupling fitting on a hose end can be secured. This fitting 16 is connected through a short union 18 and a nipple 20 to one arm 22 of a tee 24. A second arm 26 of the tee has a freeze-and-bleed valve 28 threaded into it.

This valve is a commercially available valve that is normally open. It closes automatically when pressurized water fills the valve. In the open position, this valve communicates with the environment for draining water from the device.

The third arm 32 of the tee is connected through a close nipple 34 to one arm 36 of a normally closed valve 38. This valve 38 is of conventional construction, internally spring-biased to the closed position, with an external, reciprocable plunger 39 that can be pressed in to move the valve to its open position. A bracket 40 is secured to the lower end of valve 38 and is disposed to project toward the front end of the device. A trigger 41 is pivotally mounted on a pin 41*a* carried by the bracket 40. The trigger 41 is formed at its upper end with a pair of arms 42*a*, 42*b* respectively, that extend generally at right angles to each other. The lower arm 42*a* is disposed to engage against the valve plunger 39, and the upwardly-projecting arm 42*b* is disposed to have its rear face engage against the front face of the bracket 40, to limit the pivotal movement of the trigger.

The other arm 43 of the valve 38 is threadably connected to one end of a barrel 44. The barrel 44 is formed with a longitudinally-extending bore 46 that is tapered so that at its front end, that is, the end remote from the valve 38, the bore is of decreased diameter as compared to its diameter at the valve 38. The reduced diameter front end of the bore 46 is the discharge end 48 of the device.

The housing 14 is formed, generally by casting, so that the assembled body 12 can be snugly received within it. Structurally, the housing 14 is formed with a pair of walls 50, 52 (FIG. 2) that are spaced apart just sufficiently to permit insertion of the body between them. Thus at the back end of the device 10, the walls 50, 52 are spaced relatively far apart to accommodate the relatively wide valves 28 and 38, respectively. At the back end of the device, these walls are interconnected by a back panel 54 that is formed with a connection opening 55 and that is integral with a top shroud portion 56.

Toward the midpoint of the housing, and adjacent the normally closed valve 38, the walls 50, 52 are formed respectively with upstanding vertically extended portions 58, 60, respectively, that extend at least as high as the actuating valve 38, to protect it. As the walls 50, 52 extend from these vertically extended portions 58, 60 toward the front end of the device, they are recessed, to expose the barrel 44. At the front end of the device, the walls are united with each other by a front end shroud 62.

The wall sections of the housing may be cut away, as indicated at numeral 64 (FIG. 1), for example, to decrease the weight of the device and to enhance its appearance.

Figure 1:
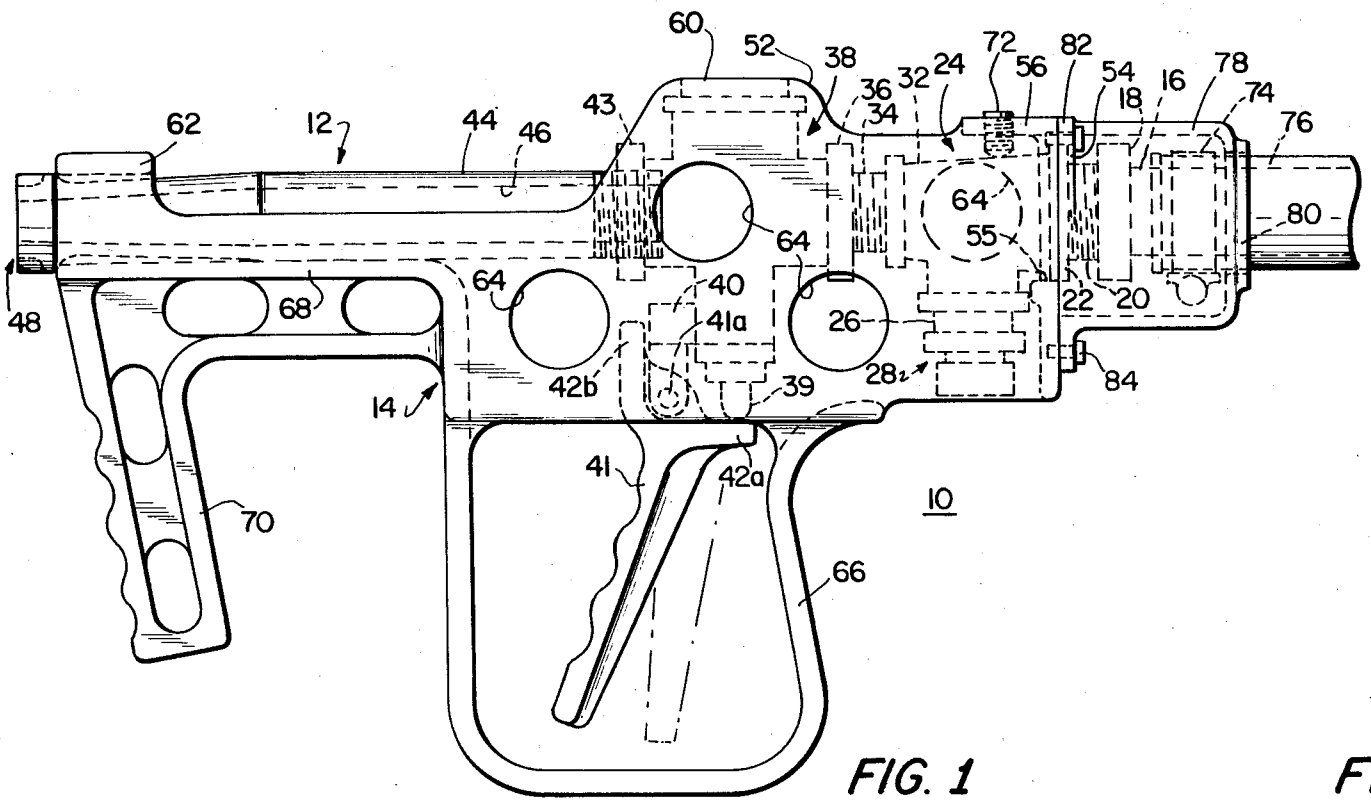
FIG. 1 is a side elevation of a gun type of washing device constructed according to one embodiment of the present invention, showing a closure cover fastened in place at the location where the end of the hose is connected to the device.

Approximately at the midpoint of the housing, it is formed with a downwardly depending rigid loop 66 that provides the main handgrip for the device. As best shown in FIG. 1, this loop 66 is positioned so that the actuating member or trigger 41 is conveniently positioned within the open area of the loop. The rear of the handgrip loop 66 is positioned relative to the trigger 41 so that an operator can conveniently grasp the trigger 41 with his or her fingers, while the palm of the hand engages against the rear arm of the handgrip 66.

The housing is formed at its front end with a bottom web portion 68, on which the barrel 44 can rest. In addition, the housing is formed adjacent its front end with a second handgrip 70, to facilitate handling and aiming of the device.

To assemble the body of the device into the housing, generally the body parts are assembled one to the other except for the barrel. The nipple 20 is inserted through the opening 55 in the back panel 54 of the housing, with the other parts then being located in the positions shown in FIG. 1. The union 18 and fitting 16 are then connected to the end of the nipple 20. The barrel is then inserted into the housing and its rear end is threaded into the front arm 42 of the normally closed actuating valve 38. While the housing is formed so that the body fits snugly within it, there is some "play". To minimize or eliminate this "play", a set screw 72 is threaded through an opening in the back shroud 56, to engage against the upper surface of the tee 24, to apply pressure to it so as to secure the body within the housing.

To use the device, the female coupling 74 of a hose end 76 is threaded to the male coupling 16 and securely tightened so there are no leaks.

In order to prevent pilferage of the device, preferably a closure cap 78 is made a part of the device. This closure cap 78 is generally cylindrical, with an opening 80 at its back face and a flange 82 extended peripherally about the open front end of the closure cap. To use this closure cap, it is placed over the hose end 76 before the hose end is connected to the device. Then, after the hose end 76 is connected, the closure cap 78 is moved so that the front face of the flange 82 butts up against the rear face of the back panel 54 of the housing. Three one-way screws 84 are then inserted in preformed openings in the two parts and tightened in place, to prevent removal of the closure cap except through the use of a special tool, or by drastic means such as drilling out the screws.

Once the device has been connected to a water hose or other source of fluid that is to be applied, the device is very easy to use. The operator grasps the two handgrips. To permit water to flow from the outlet 48 of the barrel 44, the trigger 41 is pulled back, causing the plunger 39 to move upwardly and inwardly of the actuating valve 38, to open it. The position of the trigger 41 can be adjusted to control the volume of water or other fluid that is being discharged. For full force, the trigger 41 is pulled back as far as it will go.

After the device has been used, as for washing vehicles, the water supply to the hose is turned off. The freeze-and-bleed valve 28 automatically opens, to permit any water in the device and in the hose to bleed to the environment. This prevents damage to the device and hose in cold weather, should freezing occur.

The device is easily taken apart for routine maintenance. If the device is made from stainless steel, it will possess great durability. However, for lighter weight, the device can also be made from lighter materials such as, for example, high strength nylon. The device is so constructed that it can be conveniently operated by either a right- or left-handed operator. The automatic shut-off feature provided by the normally closed actuating valve 38 in the device prevents the waste of water.

Figure 3:
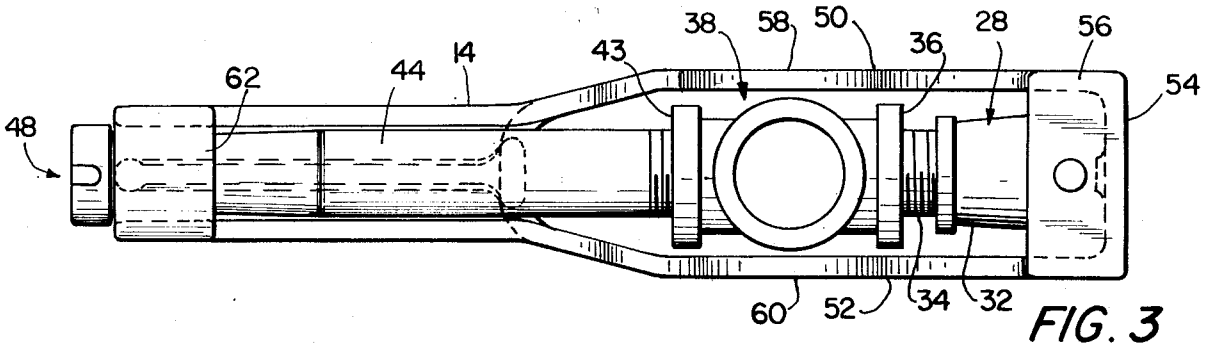
FIG. 3 is a top plan view thereof.

While the invention has been illustrated in FIGS. 1–3 in connection with one preferred embodiment thereof, much more compact designs can be used. For example, the length of the barrel can be reduced substantially if desired. Reducing the overall size of the device generally has the advantage of decreasing its weight, and a lighter device ordinarily is less tiring.

In the preferred embodiment illustrated in FIGS. 1–3, the protective housing includes a handgrip that completely surrounds the trigger mechanism that actuates the valve plunger 39. However, valve actuating mechanisms are available that are less sensitive to shock such as, for example, ball valves. Such more rugged, less sensitive valves may require a protective housing only about the valve area and not around the entire trigger mechanism. In addition, the use of the protective cover to eliminate pilferage is preferred, but it also can be eliminated to decrease the weight of the device.

While the device has been primarily designed for use in washing vehicles with water, it could be used for dispensing other kinds of liquids where ease of control, high volume, and durability are required. For example, it would be useful for spraying foam and chemicals, for fire fighting.

In order for the device to deliver a high volume of water, it is essential that it offer the least resistance possible to the flow of water through the device itself. In the embodiment of the invention shown in FIGS. 1–3, the plunger-actuated valve 38 is of a type that forces the water through a change of direction. This is a sufficient impediment to flow so that the delivered volume is decreased somewhat.

Figure 4:
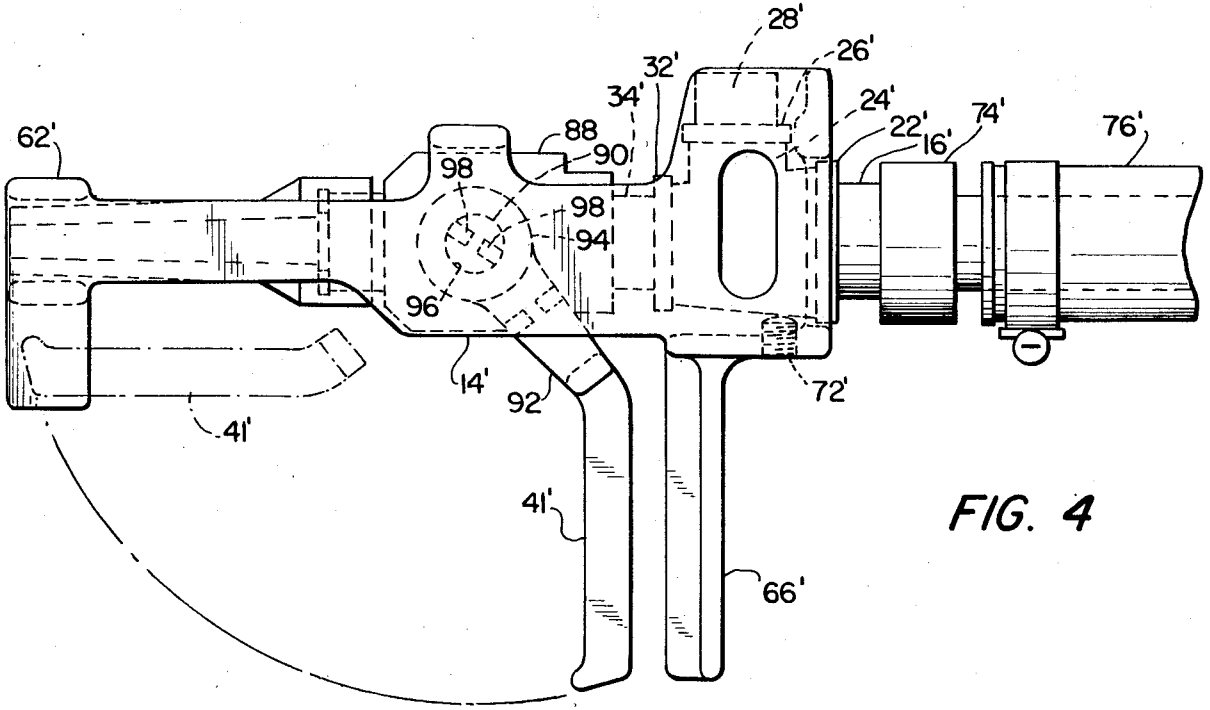
FIG. 4 is a side elevation of the gun type of washing device constructed in accordance with another embodiment of the invention, designed to be lighter in weight than the device shown in FIG. 1, and with an improved design for better linear fluid flow.

In the modified embodiment of the invention shown in FIG. 4, the device has been designed differently to reduce its weight and also to decrease the resistance to flow caused by the internal channels in the body. However, a basically linear path through the device for the flow of fluid is present in both illustrated embodiments of the invention.

Referring now to FIG. 4, those parts that are essentially the same parts as those in FIG. 1 are identified by primed numerals corresponding to the numerals used in FIG. 1 for the same parts.

The actuating valve 88 is of a different design, particularly internally. This valve is designed internally (not shown) so that in its fully open position, a passage is provided through the valve that is essentially the same size and in registry with the communication openings in the valve body, so that the valve member itself and its port offer the least possible resistance to water flow therethrough. The design of the main handgrip has been modified so that it is a single vertical beam 66' that projects downwardly from the housing. The trigger 41' is also modified to accommodate the different construction of the actuating valve 88. This valve 88 is formed with a shaft 90 whose ends project at each side, respectively, of the valve. These ends are connected to the arms 94 of a yoke 92. The yoke arms 94 are formed with circular bores 96 respectively into which the ends of the shaft 90 are inserted. A pair of set screws 98, one on each side of the device, secure the arms 94 of the yoke 92 to the ends of the shaft 90, to prevent relative rotation between the two. When the trigger 41' is in the down position shown in full line in FIG. 4, the actuating valve 88 is open.

A spring (not shown) is interposed between the housing 14' and the trigger 41', constantly to urge the trigger 41' to the dashed line position shown in FIG. 4, in which the actuating valve 88 is in its closed position.

This modified embodiment of the invention shown in FIG. 4 can be shorter in length and much lighter than the embodiment illustrated in FIG. 1. In addition, when both the freeze-and-bleed valve 28' and the actuating valve 88 are selected from among those commercially available valves that, in the open position, do not cause a change in direcion for the water flow, and offer minimum resistance to flow, this embodiment of the washing device can deliver an optimized volume of water as compared to the embodiment shown in FIG. 1, given the same hose diameter and pressure.

While the invention has been disclosed in this patent application by reference to the details of preferred embodiments of the invention, it is to be understood that this disclosure is intended in an illustrative rather than in a limiting sense, as it is contemplated that modifications will readily occur to those skilled in the art, within the spirit of the invention and the scope of the appended claims.

What is claimed is:

1. A gun type fluid control device comprising:

a. a housing including an elongate handle;

b. means for providing a linear flow path having a substantially uniform cross section through said housing terminating in a nozzle;

c. a bleed valve, communicating with said linear flow path means, for automatically draining said flow path means when the fluid pressure therein falls below a predetermined level;

d. a fluid flow control valve, located in said linear flow path means, operable to control the fluid flow through said flow path means between a open position and a closed position, said control valve in its open position providing a flow path having a cross section substantially identical in size to the cross section of said linear flow path means and providing a flow path in registry with said linear flow path means, said control valve in its closed position stopping the flow of fluid in said linear flow path means; and e. an elongate trigger operably connected to said fluid flow control valve for actuating said valve between its open position and its closed position as said trigger is manually moved between a first position and a second position, respectively, said trigger being adjacent said handle in said first position.

2. The apparatus of claim 1 further comprising:

a. socket means for coupling a source of fluid pressure to said linear flow path means; and b. a closure member mounted on said housing and enclosing said socket means for preventing access to said socket means.

* * * * *